United States Patent [19]

Teramoto et al.

[11] 4,234,943

[45] Nov. 18, 1980

[54] MONTH CORRECTING MECHANISM FOR CALENDAR TIMEPIECES

[75] Inventors: Kazuo Teramoto, Fuchu; Minoru Watanabe, Tokorozawa; Tetuo Matumura, Tokyo, all of Japan

[73] Assignee: Citizen Watch Co., Ltd., Tokyo, Japan

[21] Appl. No.: 963,173

[22] Filed: Nov. 24, 1978

[30] Foreign Application Priority Data

Nov. 26, 1977 [JP] Japan ..... 52-141883

[51] Int. Cl.[3] ..... G04B 27/08

[52] U.S. Cl. ..... 368/35; 368/28; 368/37; 368/185

[58] Field of Search ..... 58/4 R, 4 A, 58, 85.5

[56] References Cited

U.S. PATENT DOCUMENTS

| | | | |
|---|---|---|---|
| 203,640 | 5/1878 | Paddock | 58/58 |
| 1,997,511 | 4/1935 | Canepa | 58/58 |
| 2,147,280 | 2/1939 | Basler | 58/5 |
| 3,400,510 | 9/1968 | Schwarzer et al. | 58/4 R |
| 3,716,983 | 2/1973 | Tanaka et al. | 58/58 |

*Primary Examiner*—Ulysses Weldon

*Attorney, Agent, or Firm*—Birch, Stewart, Kolasch & Birch

[57] ABSTRACT

A month correcting mechanism for calendar timepieces comprises a month indicating dial having a toothing and a month dial correcting lever assembly adapted to be engaged with the toothing of the month indicating dial. By manually actuating the month dial correcting lever assembly, the month indicating dial may be rotated independently of the date dial to correct the indication of the month.

12 Claims, 5 Drawing Figures

MONTH CORRECTING MECHANISM FOR CALENDAR TIMEPIECES

BACKGROUND OF THE INVENTION

The present invention relates to a month correcting mechanism for calendar timepieces.

Calendar watches having a date, week day and month indicators are available in the prior art. The calendar mechanism comprises a month dial, date dial and month dial driving mechanism adapted to drive the month dial one step during the rotation of the date dial between the indications "31" and "1". To correct the month indication, the date dial correcting mechanism must be operated. Accordingly, when there is about a one year lag between the month indication and the actual month, the date dial must be rotated through a rotation of about one year. This is a very troublesome manipulation.

SUMMARY OF THE INVENTION

It is an object of the present invention to provide a mechanism which operates to quickly correct the month indication.

In accordance with the present invention there is provided a month correcting mechanism comprising a date dial having a toothing, a month dail having a toothing, a driving member adapted to engage the toothing of said date dial for driving it one step every 24 hours, a month dial driving device for driving said month dial one step during the rotation of said date dial between the date indications "31" and "1", and a month correcting lever assembly provided to engage with said toothing of said month dial and adapted to be manually actuated to drive said month dial independently of the date dial.

These and other objects and features of the present invention will become fully apparent from the following detailed description in conjunction with the accompanying drawings.

BRIEF DESCRIPTION OF THE DRAWINGS

The present invention will become more fully understood from the detailed description given hereinbelow and the accompanying drawings which are given by way of illustration only and thus are not limitative of the present invention, and wherein.

DESCRIPTION OF THE PREFERRED EMBODIMENTS

Figure 1:
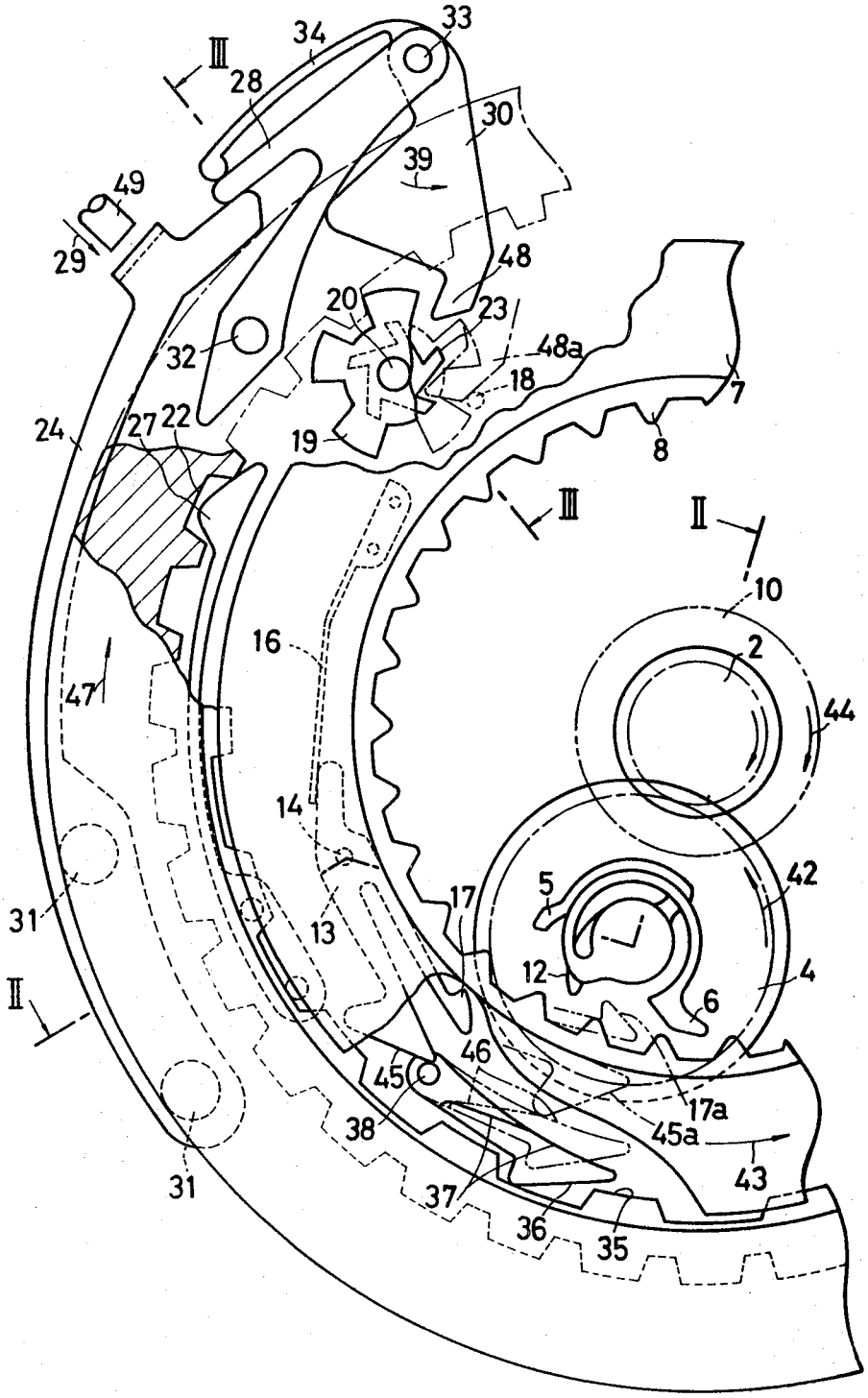
FIG. 1 is a plan view showing a calendar mechanism employing a month correcting device in accordance with the present invention.

Referring to the drawings and more particularly to FIGS. 1 to 4, numeral 1 refers to a base plate, 2 is an hour wheel and 3 is a calendar plate for the calendar mechanism. A date dial driving wheel 4 is pivotally mounted on a pin 4*a* secured to the base plate 1 and is engaged with the hour wheel 2, so that it may be rotated by the hour wheel 2 one full turn for every 24 hours. On the pin 4*a* are pivotally mounted fingers 5, 6 and an additional finger 12 which are integrated with each other and the lowermost finger 5 is secured to the wheel 4, whereby these fingers may be rotated together with the wheel 4. The finger 5 is adapted to be engaged with toothing 8 of an annular date dial 7 during one revolution of the wheel 4 to drive the date dial one step every 24 hours. The date dial 7 is coaxial with center of the watch and rotatably mounted on the calendar plate 3 and slidably secured thereto by tabs 9. The finger 6 is adapted to be engaged with a star wheel 10 integrated with a week day dial 11 to rotate it one step every 24 hours. The date dial 7 and the week dial 11 are positioned at every indicating position by a jumper spring, respectively, not illustrated in the drawings.

There is provided a space for an auxiliary lever 13 between the date printing surface 15 and the toothing 8 of the date dial 7. The auxiliary lever 13 is pivotally mounted on a pin 14 secured to the date dial 7 and biased by a spring 16 in the clockwise direction in FIG. 1, so that the pawl portion 17 of the auxiliary lever is maintained in the retracted position as shown by solid line in FIG. 1. Outside the date dial 7, an annual month dial 21 is rotatably provided on the calendar plate 3. The month dial is provided with an annular projection 22*a* on the underside thereof and a toothing 22 on the inner side of the annular projection as shown in FIG. 2. The annular projection 22*a* is slidably engaged with an annular groove 25 provided on the calendar plate 3. Tabs 26 provided on the calendar plate 3 slidably engage annular groove of the periphery of month dial 21, whereby the month dial is rotatably maintained on the calendar plate. The circumferential portion of the month dial is maintained by a jumper spring 27 engaged with toothing 22. The toothing 22 engages a month dial driving wheel 19 secured to a pin 20 pivotally mounted on the base plate 1, and the wheel 19 is adapted to be engaged with a pin 18 provided on underside of the date dial 7 at the end of month.

Figure 3:
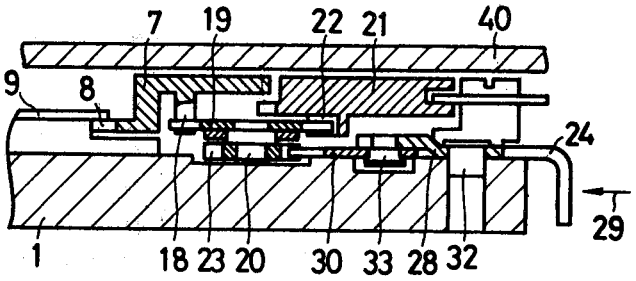
FIG. 3 is a sectional view taken along the line III—III of FIG. 1.

In accordance with the present invention, a month correcting pinion 23 is secured to the pin 20 as shown in FIG. 3. To rotate the month correcting pinion 23, a month correcting spring lever 24, a month correcting lever 28 and a month correcting pawl 30 are provided. The spring lever 24 is secured to the base plate 1 by a pin 31 at one end thereof and the other end is engaged with a bifurcated portion of the month correcting lever 28. The spring lever 24 is adapted to be biased to the month correcting lever 28 as shown by arrow 29. The month correcting lever 28 is pivotally mounted on the base plate 1 by a pin 32. The month correcting pawl 30 and the month correcting lever 28 are pivotally connected to each other by a pin 33. The month correcting pawl 30 has a resilient portion 34 of which end is engaged with the side of the month correcting lever 28.

In this embodiment, there is provided an automatic date correcting device for adjusting to the various lengths of a month. To this end a cam portion 35 is provided on the inner side of the month dial 21.

The cam portion 35 comprises a series of protrusions and indentations, the protrusions corresponding to the even months and the indentations corresponding to the odd months. A control lever 36 having a cam surface 37 is pivotally mounted on a pin 38 secured to the calendar plate 3 adjacent the cam portion 35. As shown in FIG. 2, watch dial 40 is provided with a window 41 for date, week day and month indications.

Figure 2:
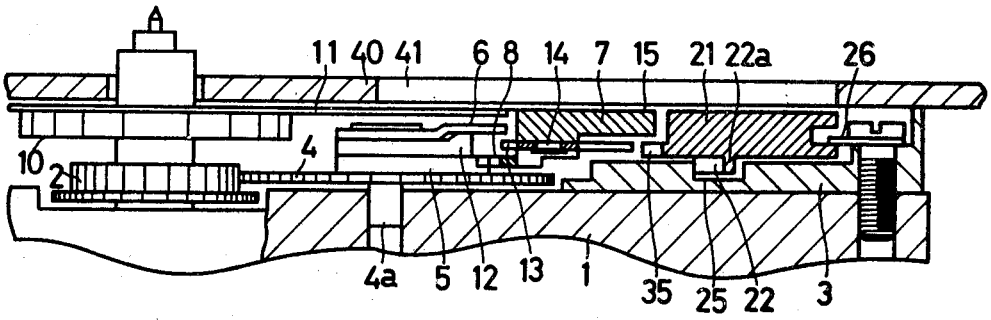
FIG. 2 is a sectional view taken along line II—II of FIG. 1.
Figure 4:
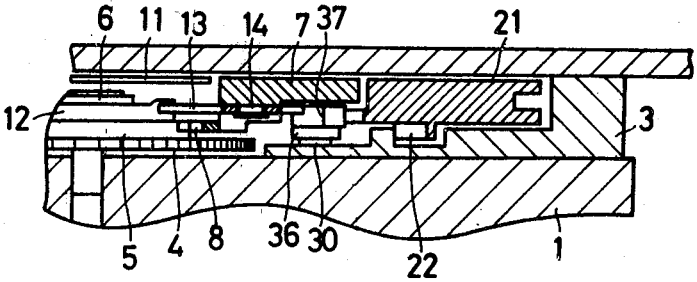
FIG. 4 is a sectional view similar to FIG. 2 and especially showing a control lever.

In operation, the wheel 4 is driven one full turn every 24 hours in the direction of the arrow 42 in FIG. 1, so that the date dial 7 and week day dial 11 may be driven one step every 24 hours in the directions 43 and 44 by fingers 5 and 6, respectively. In the even months, the control lever 36 engages the protrusion of the cam portion 35, so that the control lever is moved to the inwardly projected position shown by dotted line in FIG. 1. When 30th day comes around, the auxiliary lever 13 reaches to the control lever 36, so that the tapered portion 45 of the auxiliary lever engages the projected cam surface 46. Consequently, the auxiliary lever 13 is pivoted counter-clockwise by the cam surface 46, to the dotted line position 17*a* and 45*a*, where projected pawl 17*a* is in the path of the finger 12. It should be noted that the cam surface 37 is raised from the surface of the control lever 36, so that the tapered portion 45 may engage the cam surface without engaging other parts of the control lever (FIG. 4).

In the night of 30th day, the additional finger 12 engages the projected pawl 17*a* to drive the date dial 7 one step and further the finger 5 engages a tooth of the toothing 8, as usual, to drive the date dial one more step. Thus, the date dial 7 is driven two steps at the night of 30th day, thereby bringing indication "1" into the window 41 at the beginning of the next month. During the rotation of the date dial 7 from "31" to "1", the pin 18 of the dial 7 engages the wheel 19 to rotate the month dial 21 one step in the direction of the arrow 47, whereby month indication in the window 41 changes to the next month indication.

In the odd months, the control lever 36 engages the indentation of the cam portion 35 so that the lever is in the retracted position as shown in FIG. 1 by the solid line. Therefore, the auxiliary lever 13 does not project inwardly as much as in the even month. Thus, the finger 12 does not engage the pawl 17 and hence the date dial is driven one step by the finger 5 bringing the date indication "31" into the window 41.

To correct the month dial 21, the month correcting spring lever 24 is biased in the direction the arrow 29 by operating a suitable manipulating member such as a pushbutton 49. The movement of the month correcting spring lever 24 causes the month correcting lever 28 to rotate about the pin 32 together with the month correcting pawl 30, so that the end 48 of the pawl 30 engages with the month correcting pinion 23 and reaches to the position 48*a*.

Thus, the month correcting pinion 23 is rotated one step together with the month dial driving wheel 19, so that the month dial 21 is rotated one step in the direction of the arrow 47. When biasing force to the month correcting spring lever 24 disappears, the month correcting lever assembly comprising members 24, 28 and 30 returns to the initial position. When the pawl 30 returns, it engages with the adjacent tooth of the pinion 23 and passes over the tooth pivoting about the pin 33 in the direction of the arrow 39 with yielding of the resilient portion 34. Thus, the month correcting lever assembly may be returned without effecting the reverse rotation of the pinion 23. By repeating the manipulation for the month correcting spring lever 24, the correction of the month dial may be performed. If the month dial is corrected at the time when the date indication "31" is in the date window 41, rotation of the month dial driving wheel 19 causes the pin 18, which is positioned adjacent the wheel 19 as shown in FIG. 1, to drive, so that the date dial 7 is driven one step in the direction of the arrow 43 resulting in the indication "1".

Figure 5:
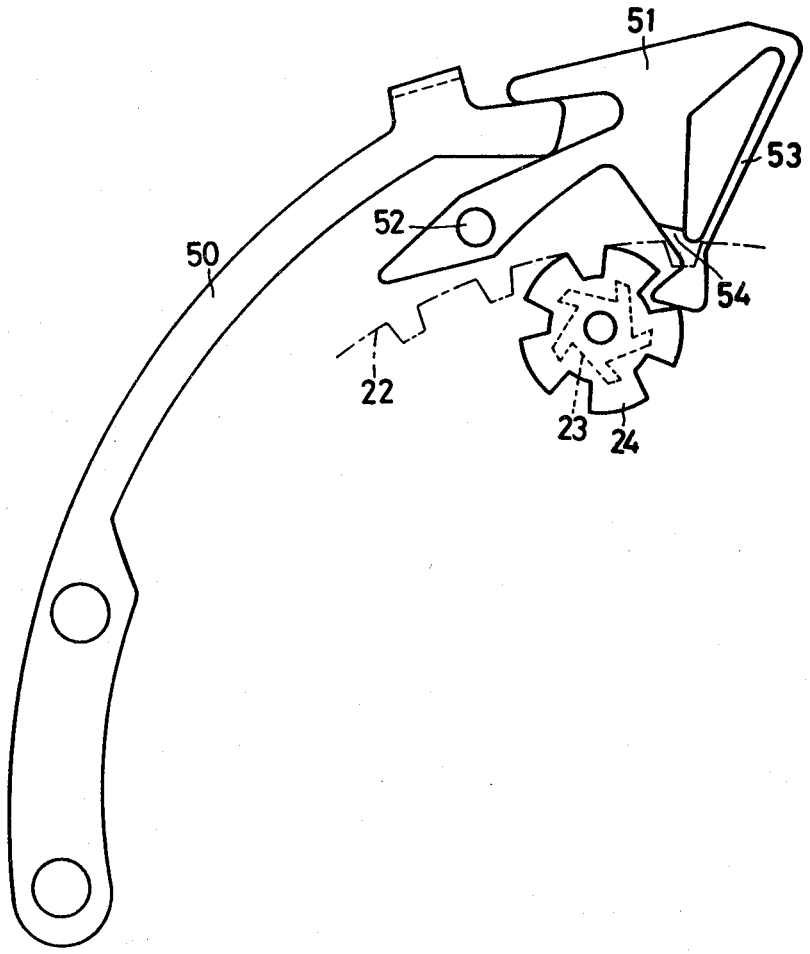
FIG. 5 is a plan view showing a part of another embodiment of the present invnetion.

Referring to FIG. 5 showing another embodiment of the present invention, the month correcting lever assembly comprises a month correcting spring lever 50 and a month correcting pawl 51. Accordingly, in this embodiment the month correcting lever 28 in the previous embodiment is omitted. The month correcting pawl 51 is rotatably mounted on the base plate by a pin 52 and has a resilient portion 53. A portion 54 near the end of the pawl abuts on the body portion of the pawl.

In operation, the month correcting pawl 51 is rotated about the pin 52 in the clockwise direction by the spring lever 50 to drive the pinion 24 one step abutting the portion 54 on the body portion. In the return stroke, the resilient portion 53 is deflected to prevent the reverse rotation of the pinion 23.

In the illustrated embodiment, although the month correcting pawl is adapted to rotate the month dial through the month correcting pinion, it is possible to design the mechanism into such a mechanism that the pinion is omitted and the pawl directly engages with the toothing of the month dial to drive it. Further, the month correcting pinion may be removed from the month dial driving wheel 19 and it is possible to provide an independent month correcting pinion.

The invention being thus desceibed, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A month correcting mechanism for calendar timepieces comprising a date dial having a toothing: a month dial having a toothing, a driving member adapted to engage the toothing of said date dial for driving it one step every 24 hours, a month dial driving device for driving said month dial one step during the rotation of said date dial between the date indications "31" and "1", and a month correcting lever assembly provided to engage with said toothing of said month dial and adapted to be manually actuated to drive said month dial independently of said date dial.

2. A month correcting mechanism for calendar timepieces according to claim 1, in which said month correcting lever assembly includes a resilient portion yieldable in return motion to prevent the reverse rotation of the month dial.

3. A month correcting mechanism for calendar timepieces according to claim 1, in which said month correcting lever assembly comprises a month correcting pawl having a resilient portion.

4. A month correcting mechanism for calendar timepieces according to claim 3, in which said month correcting pawl has an abuttment portion, which is adapted to be abutted in the advance stroke to drive the month dial and removed in the return stroke by yielding of the resilient portion.

5. A month correcting mechanism for calendar timepieces comprising: a date dial having a toothing, a month dial having a toothing, a driving member adapted to engage the toothing of said date dial for driving it one step every 24 hours, a month dial driving wheel for driving said month dial one step during the rotation of said date dial between the date indications "31" and "1", a month correcting lever assembly comprising a month correcting pawl adapted to be manually actuated, and a month correcting pinion adapted to be rotated by said pawl to drive said month dial independently of said date dial.

6. A month correcting mechanism for calendar timepieces according to claim 5, in which said month correcting pinion is integrated with said month dial driving wheel.

7. A month correcting mechanism for a calendar watch comprising:

a base plate;

a date calendar dial ring having thirty one successive date calendar display symbols and mounted for rotation on said base plate;

a month calendar dial ring having twelve successive month calendar display symbols and concentrically mounted relative to said date calendar dial ring for rotation on said base plate;

a first driving member operatively connected to said date calendar dial ring for advancing said date calendar dial ring one display symbol every twenty four hours;

a second driving member operatively connected to said month calendar dial ring for advancing said month calendar display ring at least one display symbol after a predetermined rotation of said date calendar dial ring;

a month correcting lever assembly operatively mounted adjacent to said month calendar dial ring for manual actuation to advance said month calendar dial ring independently of said date calendar dial ring.

8. A month correcting mechanism for a calendar watch according to claim 7, wherein said month correcting lever assembly including a month correcting pawl pivotally mounted on a correcting lever and being spring biased to an inoperative position.

9. A month correcting mechanism for a calendar watch according to claim 8, wherein a spring lever is operatively mounted adjacent to said correcting lever and being manually actuated to impart movement to said correcting lever, said correcting pawl and said second drive member to advance said month calendar dial ring independently of said date calendar dial ring.

10. A month correcting mechanism for a calendar watch according to claim 7, wherein said month correcting lever assembly including a month correcting pawl being integral with a correcting lever and said month correcting pawl being resilient to spring bias said correcting lever assembly to an inoperative position.

11. A month correcting mechanism for a calendar watch according to claim 7, wherein a control lever is pivotally mounted on a calendar plate for engagement with a cam surface of said month calendar dial ring, and an auxiliary lever being operatively connected to said calendar dial ring whereby said control lever being cammed outwardly upon the expiration of an even month to displace said auxiliary lever into engagement with said first drive member to advance said date calendar dial ring two display symbols, and a pin mounted on said date calendar dial ring advancing said month calendar dial ring by said second driving member a single display symbol.

12. A month correcting mechanism for a calendar watch according to claim 11, wherein upon the expiration of an odd month said control lever being retained in a recessed cam portion of said month calendar dial ring retaining said auxiliary lever in a normal position out of engagement with said first drive member and advancing said date calendar dial ring a single display symbol, and said pin mounted on said date calendar dial ring advancing said month calendar dial ring by said second driving members a single display symbol.

* * * * *